United States Patent [19]

Lasier et al.

[11] Patent Number: 4,864,686

[45] Date of Patent: Sep. 12, 1989

[54] TAMPER RESISTANT TRACK ASSEMBLY

[75] Inventors: Thomas R. Lasier, Princeton; Thomas G. Ford, Tiskilwa, both of Ill.

[73] Assignee: Schlage Lock Company, San Francisco, Calif.

[21] Appl. No.: 282,578

[22] Filed: Dec. 12, 1988

[51] Int. Cl.[4] ..... A47H 1/04; E05F 1/00; E05F 3/00

[52] U.S. Cl. ..... 16/95 R; 16/49; 16/71; 104/140

[58] Field of Search ..... 16/49, 87.4 R, 87.4 W, 16/87.6 R, 87.6 W, 95 R, 95 W, 95 D, 95 DW, 71, 102; 104/140

[56] References Cited

U.S. PATENT DOCUMENTS 454,304 6/1891 Terry ..... 16/95 R 3,415,562 12/1968 Petersen ..... 16/49 X 4,483,045 11/1984 Shelton et al. ..... 16/95 R 4,759,099 7/1988 Morano ..... 16/49

4,765,022 8/1988 Siegal et al. ..... 16/95 D

*Primary Examiner*—Nicholas P. Godici

*Assistant Examiner*—William Scott Andes

*Attorney, Agent, or Firm*—Walter C. Vliet

[57] ABSTRACT

Disclosed is a tamper resistant assembly of a roller or slider in a track that can be used advantageously in schools, public buildings, detention facilities and the like; wherever the potential for vandalism and mischief is likely. In the present device the track is provided with unique sloped ends which expel, up and out, any foreign material placed in the track as it is moved along by the roller or slider toward the end of the track where it would ordinarily jam.

6 Claims, 1 Drawing Sheet

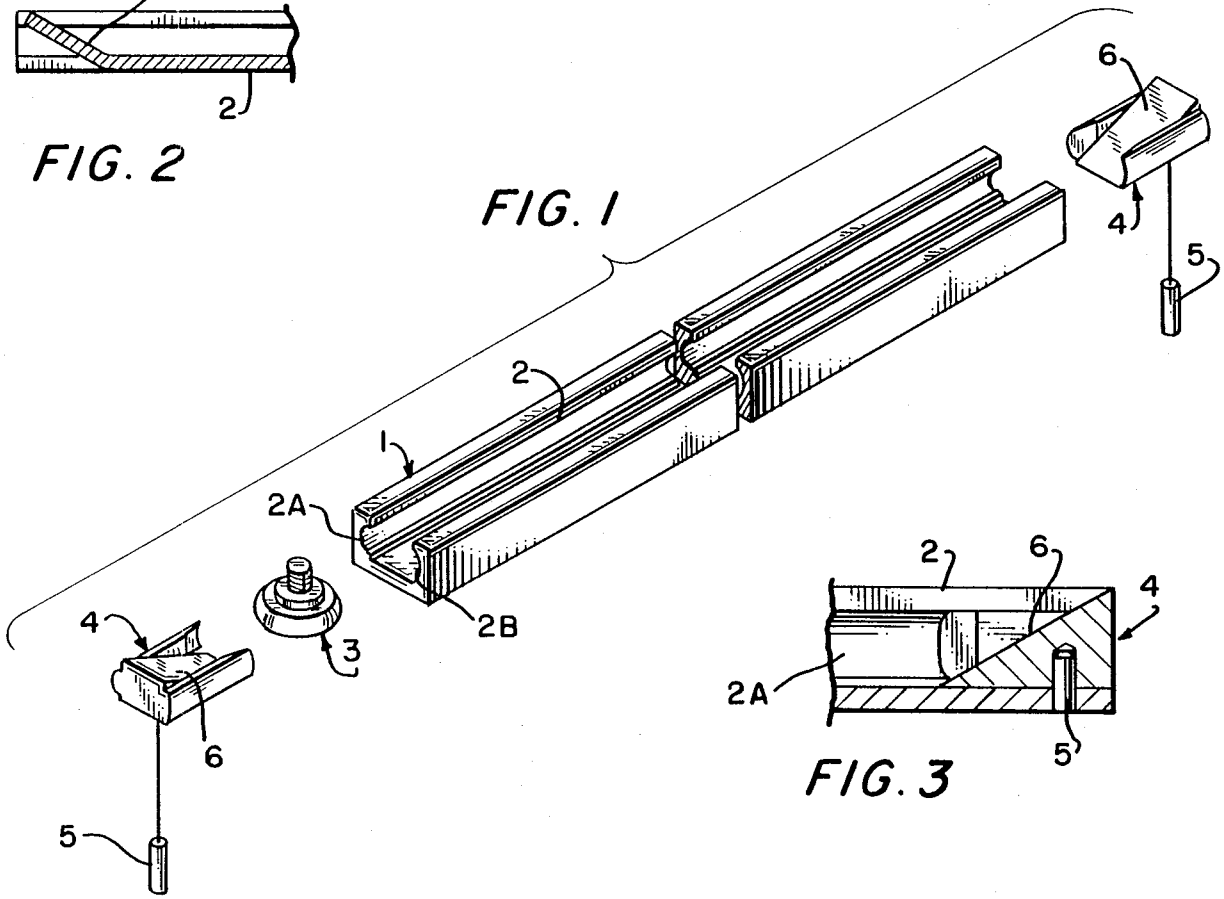
FIG. 1
FIG. 3
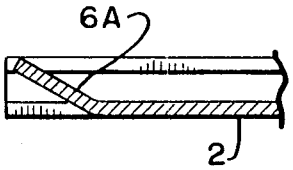
FIG. 2

TAMPER RESISTANT TRACK ASSEMBLY

BACKGROUND OF THE INVENTION

Door closers using arm and roller assemblies in a track are well known in the art. Jamming of the roller in the track can prevent normal function of the door closer and become a source of damage of the door closer and door in attempts to defeat, destroy or vandalize the door closer. Foreign objects have been placed in the track which in the past have jammed the roller or slider and with the mechanical advantage of the large door panel have effected considerable damage and/or potential malfunction of the door closer device.

SUMMARY OF THE INVENTION

The present invention provides a means at each end of the track for expelling foreign objects placed in the track. It is therefore an object of the present invention to provide a means for clearing foreign objects from a track and roller/slider combination. The means further comprising: sloped track ends which conveniently expel foreign objects rather than have them jam in the track. It is a further object to provide a simple, safe, and easily manufactured means of expelling track debris.

BRIEF DESCRIPTION OF THE DRAWINGS

FIG. 1 shows track assembly according to the present invention in isometric pictorial view.

FIG. 2 is a side view of the track showing an alternate embodiment.

FIG. 3 is a cross section of the sloped ramp installed in the track according to the present invention.

DESCRIPTION OF THE PREFERRED EMBODIMENT

Referring to FIG. 1, a track for a conventional door closer is shown having installed therein a roller assembly which traverses the track upon opening and closing of the door. It should be appreciated by one skilled in the art that debris such as wadded paper, pencils, pieces of chalk, wood or the like may be forced into the track as a means of interfering with its operation. The track is generally designated by reference numeral 1 and is provided with an internal slot 2 having guide surfaces 2A and 2B which in normal operation receive a roller assembly 3 which may be attached in turn to the arm of a door closer or the like (not shown).

According to the present invention removable end caps 4 are inserted in the track slot 2 and are secured there by means of pins 5 (see FIG. 3). Each end cap is provided with a sloped surface 6 which when installed in the track at each end is used to ramp up and expel foreign objects which may be placed into the track and pushed along by the roller assembly 3.

In an alternate embodiment shown in FIG. 2, the slope at the end of the track 6A may be accomplished by bending up a portion of the track as shown. This provides for expelling materials in the same way as the inserts of the previous embodiment.

Having described our invention in terms of a preferred embodiment, we do not wish to be limited in the scope of our invention except a claimed.

We claim:

1. A tamper resistant track assembly having an internal slot and having ramp means to expel foreign objects from said slot.

2. A tamper resistant track assembly according to claim 1 wherein said means for expelling foreign objects comprises a sloped ramp means in said internal slot.

3. A tamper resistant track assembly according to claim 2 wherein said sloped ramp means comprises an insert in said track, said ramp means having means for cooperating with said slot configuration of said track and means for securing said insert in said track means.

4. A tamper resistant track assembly according to claim 3 wherein said means for expelling foreign objects comprises an end plug having a flat bottom portion for cooperating with a track bottom, partial cylindrical side walls for cooperating with a side wall of said track means and a slope ramp means diagonally traversing said plug means.

5. A tamper resistant track assembly according to claim 4 wherein said plug means is secured in said track means by a fastener means.

6. A tamper resistant track assembly according to claim 1 wherein said ramp means comprises a bent up portion of said track means providing a ramped up end of said track means.

* * * * *